US005697350A

United States Patent [19]

Brütsch et al.

[11] Patent Number: 5,697,350

[45] Date of Patent: Dec. 16, 1997

[54] CRANK CHAMBER VENTING ARRANGEMENT FOR AN INTERNAL COMBUSTION ENGINE

[75] Inventors: Edgar Brütsch, Stuttgart; Erhard Rau, Weiheim, both of Germany

[73] Assignee: Mercedes-Benz AG, Stuttgart, Germany

[21] Appl. No.: 808,791

[22] Filed: Feb. 28, 1997

[30] Foreign Application Priority Data

Mar. 2, 1996 [DE] Germany ..... 196 08 066.5

[51] Int. Cl.[6] ..... F02B 25/06

[52] U.S. Cl. ..... 123/572; 123/196 R

[58] Field of Search ..... 123/196 R, 572, 123/573, 574

[56] References Cited

U.S. PATENT DOCUMENTS

| | | | |
|---|---|---|---|
| 4,969,422 | 11/1990 | Ishikawa . | |
| 5,115,791 | 5/1992 | Dore | 123/572 |
| 5,123,385 | 6/1992 | Sado et al. | 123/572 |
| 5,341,772 | 8/1994 | Dohring et al. | 123/572 |
| 5,529,045 | 6/1996 | Bauer et al. | 123/572 |
| 5,582,145 | 12/1996 | Aizawa et al. | 123/572 |

FOREIGN PATENT DOCUMENTS

| | | |
|---|---|---|
| 2 108 270 | 8/1972 | Germany . |
| 691 00 092 | 1/1992 | Germany . |

*Primary Examiner*—Erick R. Solis
*Attorney, Agent, or Firm*—Klaus J. Bach

[57] ABSTRACT

In a crank chamber venting arrangement for an internal combustion engine including a crankcase defining a crank chamber and having integrally formed in an end wall thereof an oil separating chamber disposed at the top end of the crank case, a crank chamber venting passage extending between the crank chamber and the separating chamber and a return passage extending between the separating chamber and the crank chamber and including a siphon, the crank chamber venting passage and the oil return passage including the siphon are open at the end wall of the crankcase and are closed by a cover and the separating chamber is open at the top and closed by a cylinder head mounted on the crankcase such that the passages and the separating chamber can be formed integrally during casting of the crankcase without the use of sacrificial cores.

4 Claims, 3 Drawing Sheets

CRANK CHAMBER VENTING ARRANGEMENT FOR AN INTERNAL COMBUSTION ENGINE

BACKGROUND OF THE INVENTION

The invention relates to a crank chamber venting arrangement for an internal combustion engine integrated into the crankcase for venting crankcase gases and separating therefrom oil which is returned to the crank chamber through oil return passages integrally formed with the crankcase.

Such a crank chamber venting arrangement is known from DE 691 00 092 T2. In the embodiment described therein, the passages can only be manufactured by using sacrificial casting cores. Furthermore, the separating chamber in which the oil is to be separated from the venting gas is very close to the crank chamber so that a surge of oil can easily be carried with the vent gases out of the crank chamber into the separating chamber. Overall, the passages for venting and for returning the separated oil, together with the separating chamber, are not shaped or designed in a way which is particularly favorable for a high degree of separation of the oil from the venting gas.

The invention is therefore concerned with the problem of designing the passage to provide a venting system with separating chambers which are arranged within the crank case in such a way that the manufacture thereof is simple and cost-effective. Moreover, the venting passage is to be of a shape and of a length such that already within the venting passage, a relatively large proportion of the oil entrapped in the venting gas is separated.

SUMMARY OF THE INVENTION

In a crank chamber venting arrangement for an internal combustion engine including a crankcase defining a crank chamber and having integrally formed in an end wall thereof an oil separating chamber disposed at the top end of the crank case, a crank chamber venting passage extending between the crank chamber and the separating chamber and a return passage extending between the separating chamber and the crank chamber and including a siphon, the crank chamber venting passage and the oil return passage including the siphon are open at the end wall of the engine and are closed by a cover and the separating chamber is open at the top and is closed by a cylinder head mounted on the crankcase such that the passages and the separating chamber can be formed integrally during casting of the crankcase without the use of sacrificial cores.

Since the passage and cavities are open towards the outside, they can be easily incorporated into the crankcase during casting. There is no need for sacrificial cores in a cast crank case, even if they have a complicated shape in the end wall. The necessary closing-off of the passages is achieved by fitting on a cover in a sealed fashion. Such a cover is usually required anyhow on at least one end face of a crank case in order to retain a bearing gasket for the crankshaft. In this way, no additional part is necessary for closing off the passage cavities.

The passage so formed can be relatively long between the crank chamber and a main separating chamber. Over the length of this passage, there may be provided constrictions and widened portions in order to be able to separate as much oil as possible from the venting gas within the actual venting passage. The constrictions within the passage may be arranged in the form of baffles, which are particularly suitable for the separation of oil.

The main separating chamber into which the venting passage opens and from which an oil return passage extends into the crank chamber is open at the top where a cylinder head is mounted. As a result, the main separating chamber can also be made without the use of a sacrificial core during the manufacture of the crank case. A main separating chamber which is shaped and arranged in this way may easily be made with a relatively large volume. The main separating chamber is easily closed off by means of a gasket which is disposed between the crank case and the cylinder head and has an opening through which the venting gas flows to a location on the engine which is provided for this purpose.

The arrangement of the individual passages and of the main separating chamber permits the crank case to be manufactured easily by a die-casting method.

A particular advantage of the embodiment according to the invention resides, inter alia, in the fact that separate passages are provided for the venting of the gases and for the return of the oil from the main separating chamber to the crankcase which prevents the oil form being re-entrapped in the venting gas flow.

Providing venting passages in the interface between interconnected machine components so that they are closed is actually known from U.S. Pat. No. 4,969,422. However, an arrangement according to the invention wherein individual passages are so arranged and formed so that they can be easily manufactured together with large volume oil separating chambers simply by mounting a cover separating chambers cannot be derived from this patent.

The oil which, in the arrangement according to the invention is separated in an effective fashion after passing through a constriction located at the entrance to the main separating chamber can flow into the return passage and from there back into the crank chamber, unimpeded by the venting gas stream.

The main separating chamber is arranged vertically above the venting and return passages. The openings of the venting passage and of the return passage are provided one of top of the other in the base of the main separating chamber, the venting gas passage opening being located above the opening for the oil return passage.

In the end area adjacent to the crank chamber, the oil return passage is shaped so as to form a siphon which is reliably closed off so as to prevent venting gases from flowing therethrough.

Returning oil via a separately arranged siphon casing is already known from German Offenlegungsschrift 21 08 270, but in the arrangement described therein a separate siphon structure is utilized; the siphon is not integrated into an end wall of the crank case.

An exemplary embodiment of the invention is described below with reference to the drawings.

DESCRIPTION OF A PREFERRED EMBODIMENT

The exemplary embodiment relates to the crank case of a V-type engine. However, the invention can also be used in principle with in-line engines.

Figure 1:
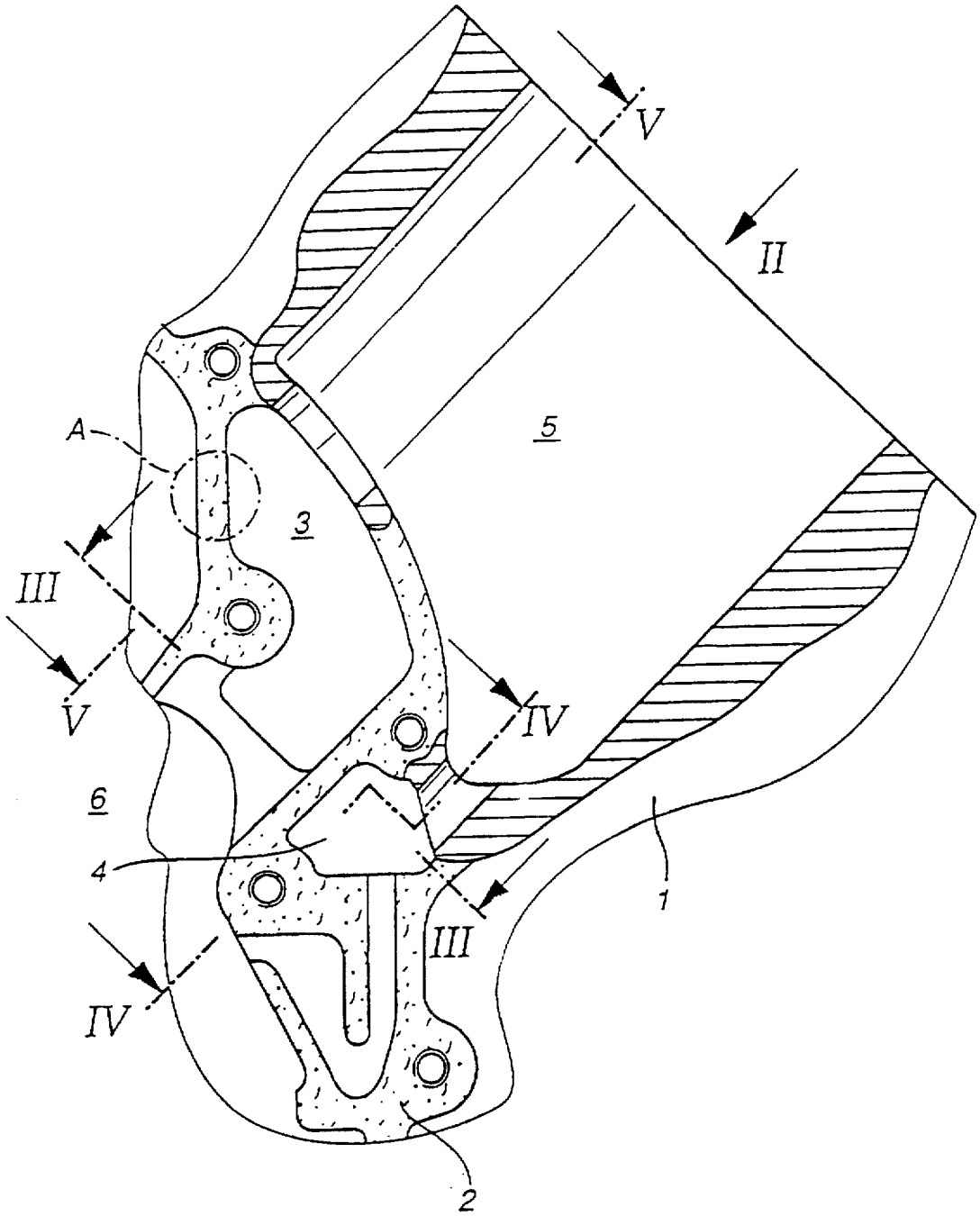
FIG. 1 shows a partial area of the end side of a crank case with an oil separating chamber shown in a cut-away area.

FIG. 1 shows only a partial area, located vertically at the top of the end wall 1 of a crank case, which partial area is significant for the explanation of the invention. The crankcase is defined as comprising the casting which includes the support structure for the crankshaft and also the cylinders of an engine. The crankcase has an end wall 1 on which a cover (not illustrated) is mounted to close the interior of the crank case. This cover rests in a sealed fashion on the flange areas 2 which are indicated in the drawing with a specific surface marking.

When a cover has not yet been fitted onto the flange areas 2, the venting passage 3 and the oil return passage 4 are open to the outside in the direction of the longitudinal axis of the crank case. As a result, the passages 4 and 5 can be produced easily when casting the crank case without using sacrificial cores. If appropriate, these passages may also be made subsequently, i.e. milled, for instance.

The main separating chamber 5, into which the venting passage 3 opens and from which the oil return passage 4 leads into the interior 6 of the crank chamber, is located within the upper part of the crank casing at a distance from the respective end wall 1 of the crank case. In the drawing, this main separating chamber 5 is therefore shown in a cut-away area of the crank case.

The passages extending from the main separating chamber 5 through a crank case end wall area are also located, as viewed from the outside, behind the end wall 1 of the crank case. These passages, i.e. openings in the respective wall, are, however, designed in such a way that they can be produced together with the main separating chamber 5 using a die casting mold slide.

The venting passage 3 is shaped over its length in such a way that the venting gas has to flow through constricted areas and widened areas. As a result, a high proportion of oil is separated from the venting gas within the actual venting passage 3 so that it flows back directly into the crank chamber.

The venting passage 3 ends downstream in a constriction with an opening to the main separating chamber 5. The main separating chamber 5 has an extremely large volume and thus provides for excellent separation of the oil entrained in the venting gas. The separated oil flows back into the crank chamber through the return passage 4. The entrance opening of the venting passage 3 into the main separating chamber 5 is at a considerably higher level than the opening of the return passage 4, so that separated oil will return through the return passage separately from the stream of venting gas.

In order to prevent venting gases from flowing through the return passage 4, the lower end of the return passage 4 leading into the crank chamber includes a siphon.

Figure 2:
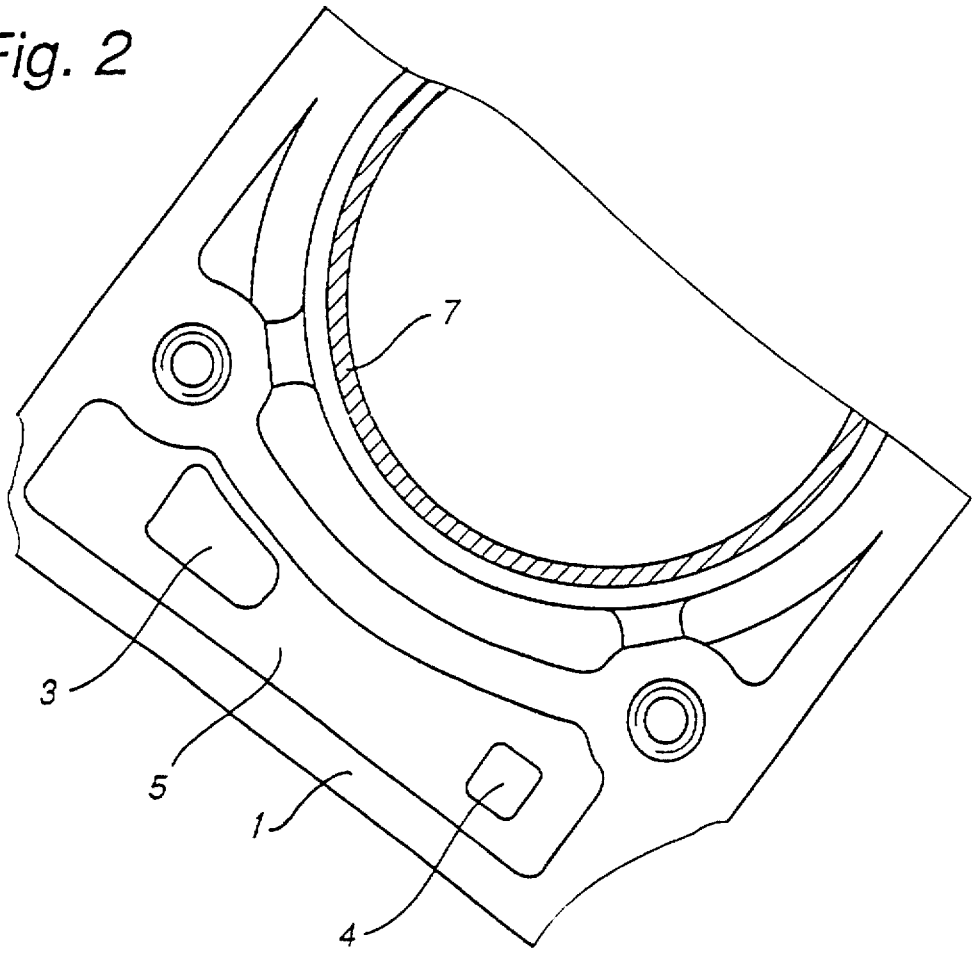
FIG. 2 is a view of the partial area of FIG. 1 taken in the direction of arrow II.
Figure 3:
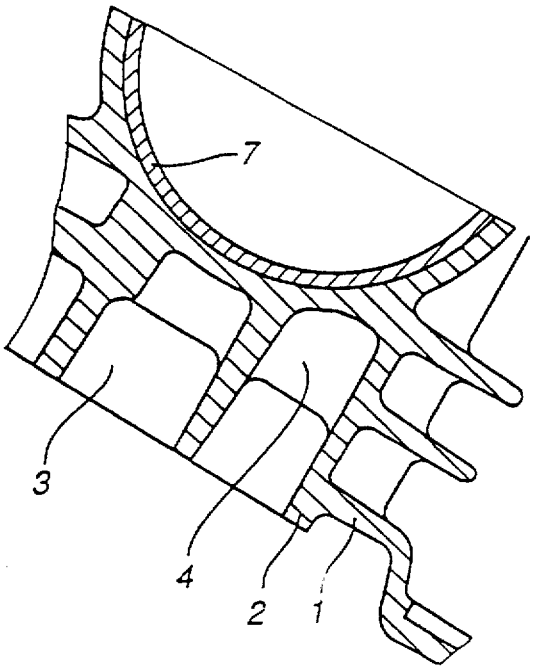
FIG. 3 is a cross-sectional view taken along line III—III of FIG. 1.
Figure 4:
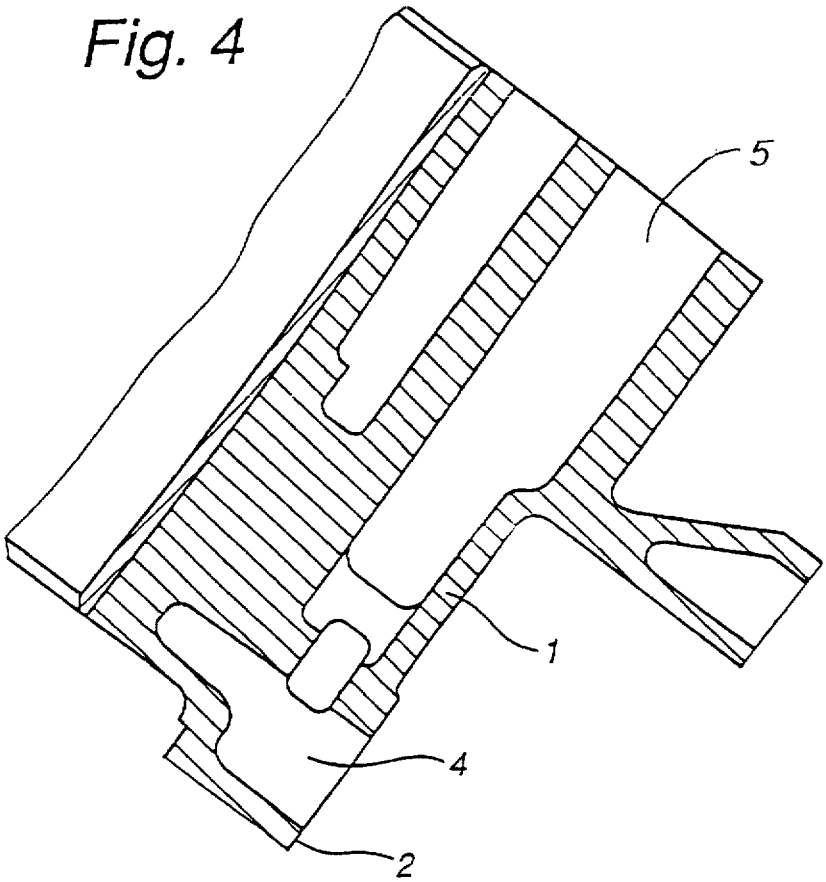
FIG. 4 is a cross-sectional view taken along line IV—IV of FIG. 1.
Figure 5:
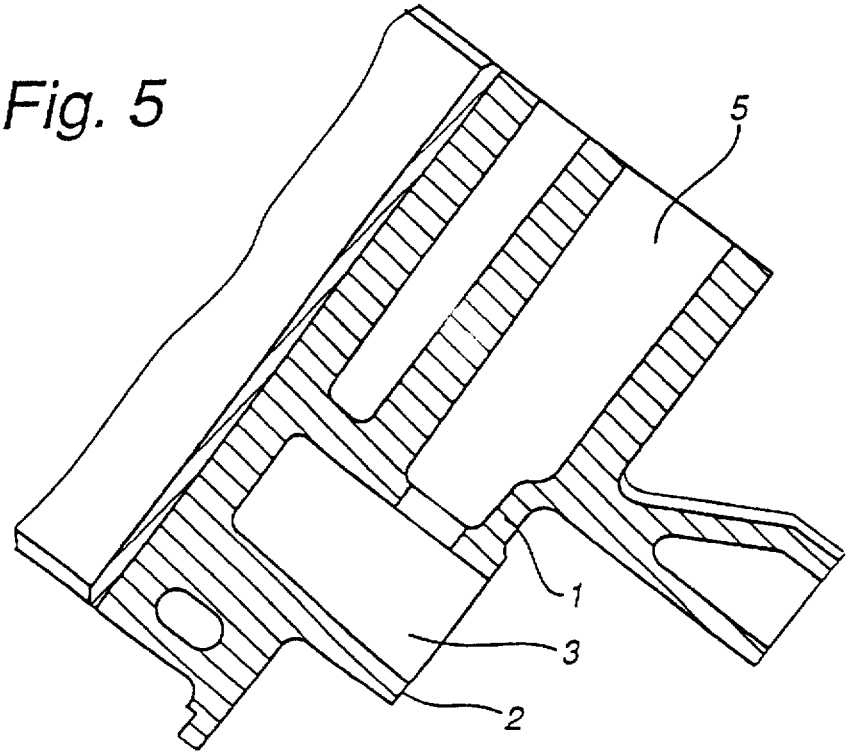
FIG. 5 is a cross-sectional view taken along line V—V of FIG. 1.

FIGS. 2 and 3 show the position of one of the cylinders 7 of the engine relative to the gas venting and oil separating structure.

The arrangement comprising the venting passage and separating chamber according to the invention can be applied both for full-load and for partial-load venting of the crank chamber. Partial-load venting is particularly suitable for engines with chain cases.

The top end of the main separating chamber 5 is delineated by a cylinder head mounted on the crankcase using a customary cylinder head gasket. Within the cylinder head, the venting gases are led through passages, integrated therein, to points on the engine which are commonly used for removing venting gases.

The venting passage 3 may include an additional opening to the crank chamber in the area marked by A in FIG. 1. In this case, there are baffles expediently located in this additional opening, the baffles being intended to prevent foamed oil from entering the venting passage 3 and possibly the main separating chamber 5. In order to increase the degree of separation for droplets of oil from the venting gas within the venting passage 3, baffle material, such as steel wool, may also be arranged in the passage cavity. In this way, the pre-separation in the venting passage 3 is further increased.

The venting passage 3 extends from the crank chamber at a location as high as possible in order to prevent oil foam from entering the venting passage 3 when the engine is for example in an inclined position.

The invention permits to provide for venting passages 3 with large flow cross-sections which generate relatively low venting gas flow speeds and little oil entrainment.

Since the crank chamber venting means according to the invention is arranged at the transmission side end wall of the crank case, the entire crank chamber may be ventilated during full-load to the cylinder head cover through the cam-shaft chain drive chamber so as to avoid oil sludging.

What is claimed is:

1. A crank chamber venting arrangement for an internal combustion engine including a crankcase defining a crank chamber and having passages and separating chambers integrated into the crank case, including a vent passage venting crankcase gases comprising a mixture of air and oil, and a separate return passage for returning oil separated from the crankcase gases back into the crank chamber, and a main separating chamber arranged above the two passages, said venting passage and said oil return passage being formed in one of the end sides of said crank case so as to be open towards the outside in the direction of the longitudinal axis of said crank case and a cover disposed on the end side of the engine side of the engine having said passages in a sealed fashion so as to close said passages, and said main separating chamber being open toward the top end of said crankcase and being covered by a cylinder head fitted onto said crankcase.

2. A crank chamber venting arrangement according to claim 1, wherein said venting passage opens into said separating chamber at a higher lever than said return passage.

3. A crank chamber venting arrangement according to claim 1, wherein said venting passage has, in its extent between said crank chamber and said main separating chamber, alternately constricted and widened areas forming oil separating means with baffle-like passage wall areas.

4. A crank chamber venting arrangement according to claim 1, wherein said return passage is in communication with the crank chamber via a passage area shaped so as to form a siphon.

* * * * *